United States Patent [19]

Shon

[11] Patent Number: 4,542,595

[45] Date of Patent: Sep. 24, 1985

[54] HAIR DRYING DEVICE

[76] Inventor: Sam Shon, 419 Glacierview Dr., Youngstown, Ohio 44509

[21] Appl. No.: 617,018

[22] Filed: Jun. 4, 1984

[51] Int. Cl.[4] ..... A45D 20/00

[52] U.S. Cl. ..... 34/95; 34/96

[58] Field of Search ..... 132/9; 34/95, 96, 99, 34/103, 3, 21

[56] References Cited

U.S. PATENT DOCUMENTS 2,453,179 11/1948 Austin .

2,470,833 5/1949 Moore ..... 34/96

2,493,363 1/1950 Sapp .

2,919,494 1/1960 Runci .

3,320,682 5/1967 Sliman ..... 34/95

4,381,611 5/1983 Wishman ..... 34/95

*Primary Examiner*—Larry I. Schwartz

*Attorney, Agent, or Firm*—Harpman & Harpman

[57] ABSTRACT

A hair drying cap that rapidly absorbs moisture from the hair of the wearer by use of multiple layers of a unique absorbent material that draws the moisture from the hair into the multiplicity of randomly arranged fibers of which the material is made greatly increasing the relative surface area exposed to the moisture.

4 Claims, 5 Drawing Figures

HAIR DRYING DEVICE

BACKGROUND OF THE INVENTION

1. Technical Field

This invention relates to hair drying garments that absorb and evaporate moisture from a person's hair.

2. Description of the Prior Art

Prior art devices of this type have relied on a variety of different designs to absorb moisture from the hair. See for example U.S. Pat. Nos. 2,435,179, 2,919,494 and 2,493,363.

In U.S. Pat. No. 2,453,179, a hair dryer is seen having multiple channels containing absorbent granular material.

U.S. Pat. No. 2,919,494 discloses a hair drying cap having several layers with a high absorbent material therebetween. The outer layer is treated to be non-porous.

U.S. Pat. No. 2,493,363 discloses a hair drying cap made of a plurality of pockets interconnected to one another filled with dry granular moisture absorbent material.

Applicant's device utilizes a multiple layer hood configuration with each layer made from a unique liquid absorbing material that draws moisture from the hair.

Only applicant's hair drying device utilizes this revolutionary fabric material in combination with a multilayer, panel-hood design.

SUMMARY OF THE INVENTION

A hair drying cap that rapidly absorbs moisture from the hair of the user by use of a multiple layer configuration. The hair drying cap employs the use of a revolutionary, new, highly absorbent material that draws the moisture away from the hair which it contacts. The hair cap configuration is such that the multiple layers enhance the absorbent qualities of the material from which they are made.

DESCRIPTION OF THE PREFERRED EMBODIMENT

Figure 1:
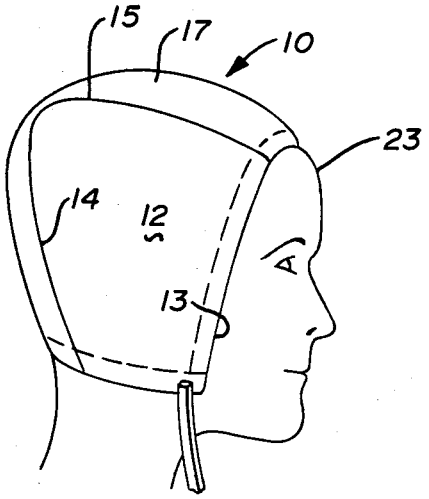
FIG. 1 is a side plan view of the drying device.
Figure 2:
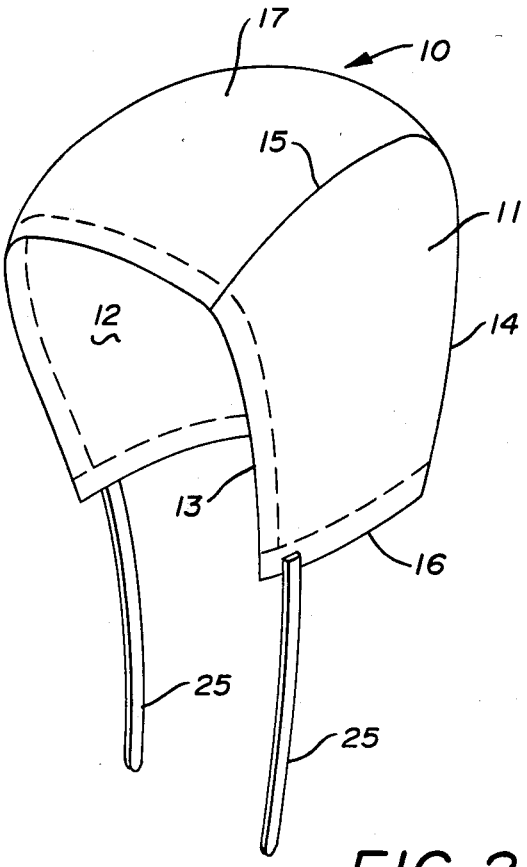
FIG. 2 is a perspective view of the drying device.

A hair drying cap can be seen in FIGS. 1 and 2 of the drawings comprising a hood 10 formed of a pair of side panels 11 and 12, each of which have downwardly tapered front and back edges 13 and 14 and top and bottom edges 15 and 16 as best seen in FIG. 1 of the drawings.

A top panel 17 is secured between said side panels 11 and 12 continuously along their top edges 15 and back edges 14 defining the hood 10 as best seen in FIG. 2 of the drawings.

Figure 3:
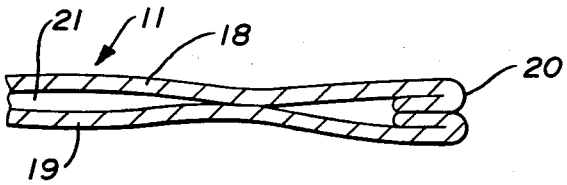
FIG. 3 is an enlarged sectional view of a portion of the drying device.
Figure 4:
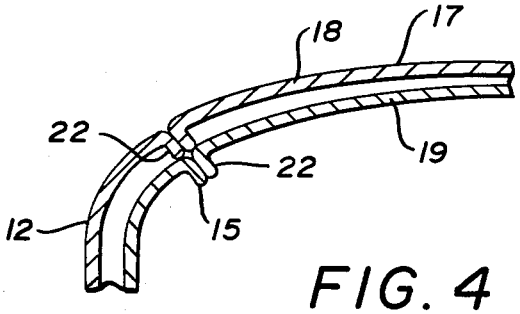
FIG. 4 is an enlarged sectional view of a portion of the drying device.

Referring now to FIGS. 3 and 4 of the drawings, each of the panels 11, 12 and 17 are formed of two spaced layers of material 18 and 19 secured to one another along their respective free edges. Each of the free edges are folded over and sewn together as at 20 defining an air space 21 therebetween the layers of material.

In FIG. 4 of the drawings, the top panel 17 is shown secured to the side panel 11 with each of the multiple layers of materials 18 and 19 joined to one another by overlapping the same and sewing at 22 as will be understood by those skilled in the art.

The multiple layers of material thus joined along the top 17 and side panels 11 and 12 edges interconnect the air spaces 20 of the panels 11 and 12 and the top 17.

From the foregoing description of the hood 10 construction, it will be evident that the hood 10 fits snugly over the head of a user 23 bringing it into direct contact with the user's hair, not shown. The inner layer of material 19 engages the user's hair absorbing the moisture from and conversely giving up the moisture to the outer layer of fabric 18. This enhanced capilary action between the fabric layers of material speeds the drying of the hair so that in a short time a substantial quantity of water can be removed.

Figure 5:
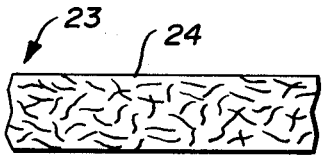
FIG. 5 is an enlarged view of a portion of said device.

Referring now to FIG. 5 of the drawings, an enlarged section of the material is shown at 23 made from a plurality of pressed individual fibers 24 in a random pattern. The fibers 24 are of spun nylon and in this fabric have a large exposed surface area due to the random and spaced arrangement in the material.

A pair of straps 25 are sewn to the panels 11 and 12 extending therefrom and seen in FIGS. 1 and 2 of the drawings.

The hair drying cap of this invention has proven in tests to be far superior to other conventional cap dryers due to the multiple layers of material separated by an air space, the overall configuration of the hood 10 made of the multiple panels and the utilization of the unique material which draws the moisture out of the hair.

It will thus be seen that a new and useful device has been illustrated and described and it will be apparent to those skilled in the art that various changes and modifications ma be made therein without departing from the spirit of the invention and having thus described my invention;

What I claim is:

1. A hair drying cap conforming to the shape of a human head comprising a hood having a plurality of panels, means for securing said panels to one another, each of said panels comprising a multiple layer configuration of a highly absorbent material, said absorbent material is porous and formed from a plurality of pressed individually spun fibers, means for securing said hood to said human head, a randomly defined plurality of air spaces between layers of said multiple layer configuration of said panels, the highly absorbent materials forming the layers of said multiple layer configuration randomly abutting one another within the panel configuration and means for communication between said air spaces within said panels.

2. The hair drying cap of claim 1 wherein said means for securing said panels to one another is by sewing each of said layers of material from each panel together separately.

3. The hair drying cap of claim 1 wherein said means for communication between said air space within said panels comprise abuting individual layers of absorbent material sewn together.

4. The hair drying cap of claim 1 wherein said means for securing said hood to said human head comprises straps on said panels.

* * * * *